US007392990B2

(12) United States Patent
Bussiere

(10) Patent No.: US 7,392,990 B2
(45) Date of Patent: Jul. 1, 2008

(54) FOOTWEAR HAVING A FOOT RETAINING SYSTEM

(76) Inventor: Stephane Bussiere, 1456 Parc Beauvoir, Sherbrooke, Quebec (CA) J1E 1A7

( * ) Notice: Subject to any disclaimer, the term of this patent is extended or adjusted under 35 U.S.C. 154(b) by 978 days.

(21) Appl. No.: 10/162,098

(22) Filed: Jun. 4, 2002

(65) Prior Publication Data

US 2003/0075884 A1 Apr. 24, 2003

(30) Foreign Application Priority Data

Oct. 18, 2001 (CA) ..... 2359377

(51) Int. Cl.
*A63C 3/04* (2006.01)

(52) U.S. Cl. ..... 280/11.18; 280/11.12; 280/28; 280/14.21; 36/54

(58) Field of Classification Search ..... 36/115, 36/116, 117.1, 117.3, 117.4, 117.6, 117.7, 36/118.1, 50.5, 89; 280/11.3, 11.36, 619, 280/621, 11.19, 11.221, 14.21, 11.17, 11.18, 280/28

See application file for complete search history.

(56) References Cited

U.S. PATENT DOCUMENTS 1,702,316 A * 2/1929 Ridgers ..... 280/11.15
3,793,749 A * 2/1974 Gertsch et al. ..... 36/117.6
4,654,985 A * 4/1987 Chalmers ..... 36/118.2
4,802,291 A * 2/1989 Sartor ..... 36/118.1
4,811,503 A * 3/1989 Iwama ..... 36/118.1
4,835,885 A * 6/1989 Hoshizaki et al. ..... 36/115
4,893,419 A * 1/1990 Arieh et al. ..... 36/118.1
4,924,605 A * 5/1990 Spademan ..... 36/114
4,937,951 A * 7/1990 Loecker ..... 36/117.8
4,937,952 A * 7/1990 Olivieri ..... 36/118.9
4,942,680 A * 7/1990 Benetti ..... 36/118.1
4,955,149 A * 9/1990 Ottieri ..... 36/117.8
5,065,530 A * 11/1991 Pozzobon et al. ..... 36/50.5
5,065,533 A * 11/1991 Paris ..... 36/118.1
5,079,859 A * 1/1992 De Bortoli et al. ..... 36/118.9
5,175,949 A * 1/1993 Seidel ..... 36/117.8
5,205,055 A * 4/1993 Harrell ..... 36/50.1
5,499,461 A * 3/1996 Danezin et al. ..... 36/117.2
5,791,068 A * 8/1998 Bernier et al. ..... 36/50.1
6,032,387 A * 3/2000 Johnson ..... 36/50.1
6,082,744 A * 7/2000 Allinger et al. ..... 280/11.12

FOREIGN PATENT DOCUMENTS

CH 668165 A5 * 12/1988
EP 629358 A1 * 12/1994

* cited by examiner

*Primary Examiner*—Paul N. Dickson
*Assistant Examiner*—Vaughn T. Coolman
(74) *Attorney, Agent, or Firm*—Eric Fincham

(57) ABSTRACT

A boot which has a tongue structure which includes at least first and second cables attached to the sides of the tongue, a guide channel associated with each cable, and a cable tensioning device connected to the cables and which is movable between first and second positions to respectfully tighten and loosen the cables. The tongue structure acts to maintain the foot in the boot and in a preferred embodiment, the tongue includes an outer somewhat rigid shell and an inner elastic layer.

11 Claims, 7 Drawing Sheets

FOOTWEAR HAVING A FOOT RETAINING SYSTEM

FIELD OF THE INVENTION

The present invention relates to footwear.

BACKGROUND OF THE INVENTION

Various types of footwear exist and such footwear has become more specialized in recent years. The present invention is directed primarily to footwear which may take the form of a boot structure although certain aspects of it are also applicable to other types of footwear. Boot type structures are used in, for example, ice skates, roller blades, ski and snowboard boots, cross country boots, work boots, etc. The present invention may be used in any of these different types of boots.

One sport which utilizes boots is hockey. Until recently, most boots have been made of plastic and have become so rigid that the natural bending ability associated with previous leather structures has become non-existent. As a result, skaters do not tighten their skates as much as previously.

Although other means have been proposed in the art including the use of various types of straps, it is still conventional to use laces to tighten shoes and boots. However, the tightening of the laces may create a pressure on a portion of the foot which can cause injuries. Minor injuries can include irritations and swelling while more major injury can occur to the tendons being torn after an impact. Sprained ankles and the like also occur.

One of the problem areas is the tongue structure and the lining of the skates. The lining can deteriorate quite quickly particularly when materials made of textiles which dry and do not have the required endurance.

A further problem encountered with ice skates is that the deterioration of various portions caused by the flexing can lead to a deformation of the sole and even the blade of the skate. The skate can also become deformed because humans frequently have a leg which is longer than the other. The pressure is then applied in an even manner when skating leading to a deformation of the skate.

SUMMARY OF THE INVENTION

It is an object of the present invention to provide for an improved ice skate which may be easily assembled and provides advantages over ice skates structures previously known in the art.

It is a further object of the present invention to provide a tongue structure which will provide protection to the foot of the user while providing a comfortable fit.

It is a further object of the present invention to provide a boot structure which may be tightened using a cable or belt system.

According to one aspect of the present invention, in a boot having an outer shell, an inner liner, and a tongue structure, the improvement wherein the tongue structure includes at least one attachment means on either side thereof, at least first and second cables, each cable being attached to a corresponding attachment means, a guide means associated with each cable, and cable tensioning means, the cable tensioning means being connected to the cables and being movable between first and second positions to respectively tighten and loosen the cables.

According to a further aspect of the present invention, a tongue structure for use in footwear, the tongue structure comprising an upper layer formed of a rigid protective material, a lower layer formed of a resilient stretchable material, the upper layer being secured to the lower layer along marginal side edges thereof, the upper layer being spaced from the lower layer intermediate the side marginal edges to thereby provide an air space between the upper and lower layers.

According to a further aspect of the present invention, in an ice skate having a boot, a blade support portion mounted on the boot, and a blade mounted in the blade support portion, the improvement comprising a first cable member connected to an upper front portion of the blade, a second cable member being secured to an upper rear portion of the blade, the first and second cable members extending through the blade support portion and being connected to each other.

According a still further aspect of the invention, in an ice skate having a boot with a sole portion, a blade support member, and a blade member mounted in the blade support member, the improvement comprising a plurality of screw threaded members extending through the sole to attach the boot and the blade support member together.

According a still further aspect of the invention, a hockey skate structure comprising an outer boot, a blade support portion, a blade mounted in the blade support portion and an inner boot, the inner boot having a sole portion, the sole portion having a toe area and a heel area, a pair of side walls extending upwardly from the sole portion, a rear wall interconnecting the side walls at the heel area, the side walls terminating short of the toe area to thereby leave an open toe portion.

According to one embodiment of the invention, there is provided an arrangement wherein the foot is supported by an inner liner which surrounds the foot on the sides and a tongue which contacts the top of the foot. Normally, laces produce a pressure directly on the tongue. However, in the instant embodiment, a pressure is exerted by pulling the sides of the tongue by means of cables or the like. When a tension is placed on the cables, they will create a pressure on the top of the foot by means of the tongue. The tongue may be provided with thicker and thinner portions—the upper portion of the tongue may be thicker to reinforce it while the portions where it flexes may be thinner.

Using the above system, one may also employ laces which merely function to secure portions of the outer boot together; the pressure on the foot is created by the cable system.

BRIEF DESCRIPTION OF THE DRAWINGS

Having thus generally described the invention, reference will be made to the accompanying drawings illustrating embodiments thereof, in which.

DESCRIPTION OF THE PREFERRED EMBODIMENTS

Figure 1:
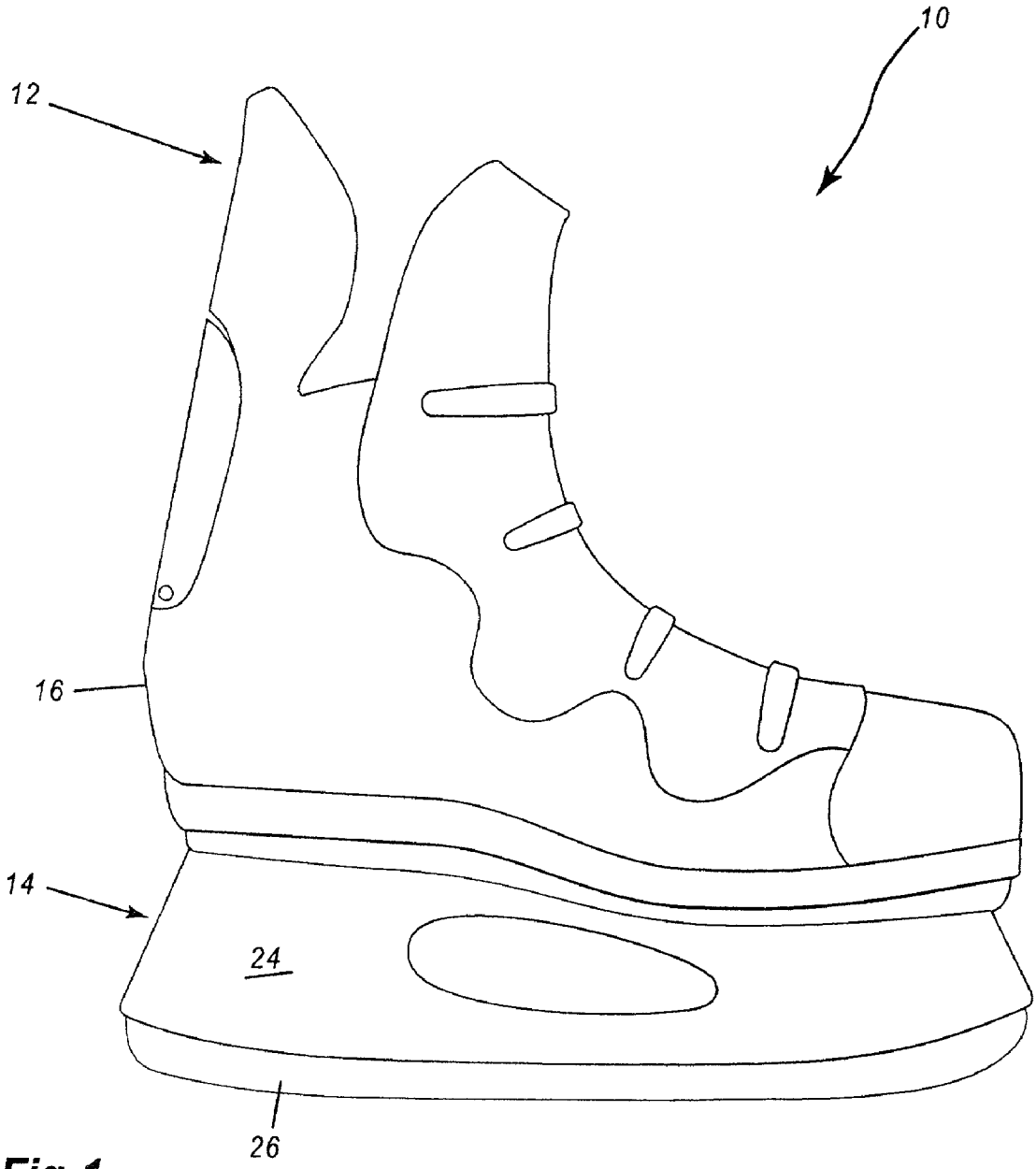
FIG. 1 is a side elevational view of a skate according to one embodiment of the present invention.

Referring to the drawings in greater detail and by reference characters thereto, there is illustrated in FIG. 1 an ice skate generally designated by reference numeral 10. Ice skate 10 includes a boot portion generally designated by reference numeral 12 and a blade assembly generally designated by reference numeral 14.

Boot portion 12 includes an outer shell 16, an inner reinforcing element 18, an inner boot or liner 19, a tongue 20, and laces 22.

Figure 8:
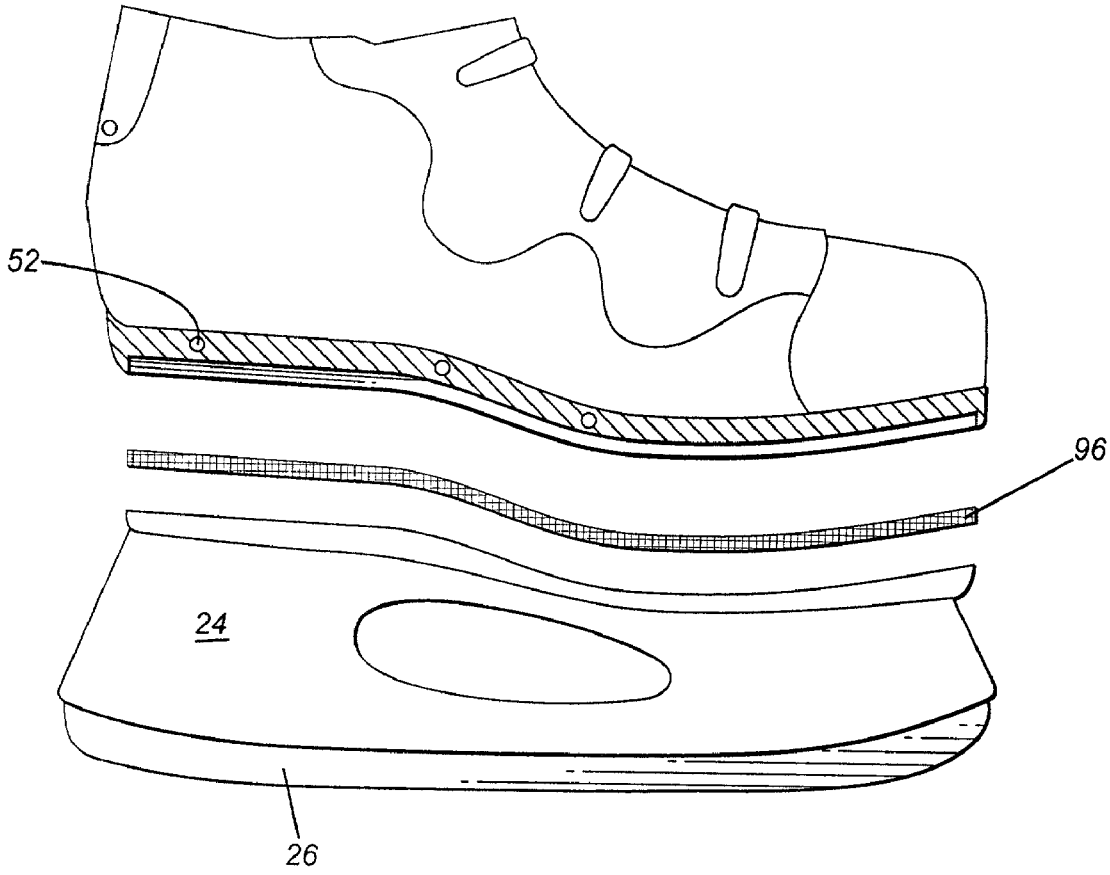
FIG. 8 is an exploded side sectional view.
Figure 9:
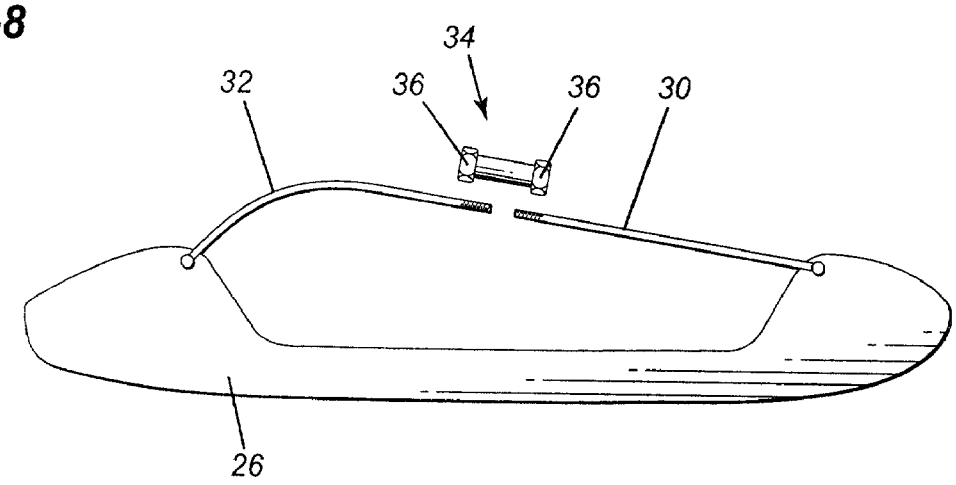
FIG. 9 is a side elevational view showing a blade tensioning mechanism according to the present invention.
Figure 10:
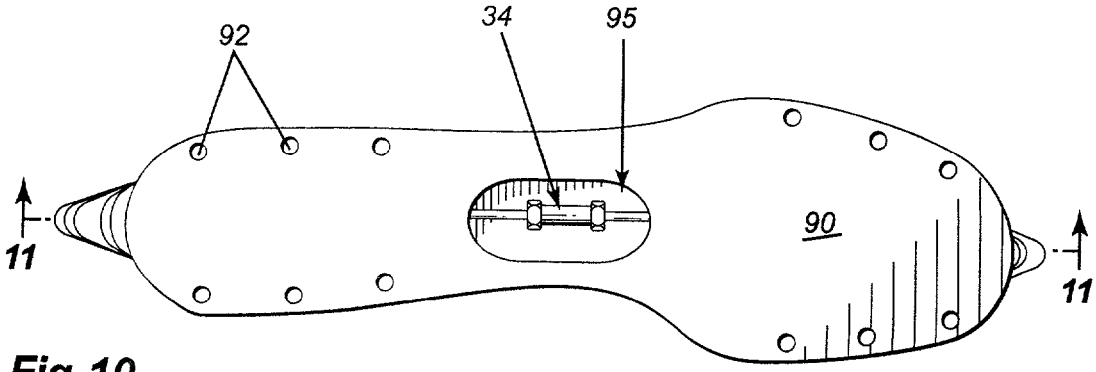
FIG. 10 is a top plan view of a sole attached to a blade assembly.
Figure 11:
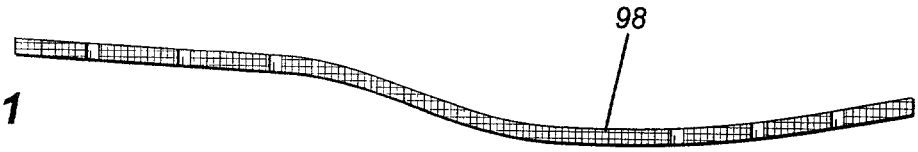
FIG. 11 is a cross sectional view of a foot adjustment member.
Figure 12:
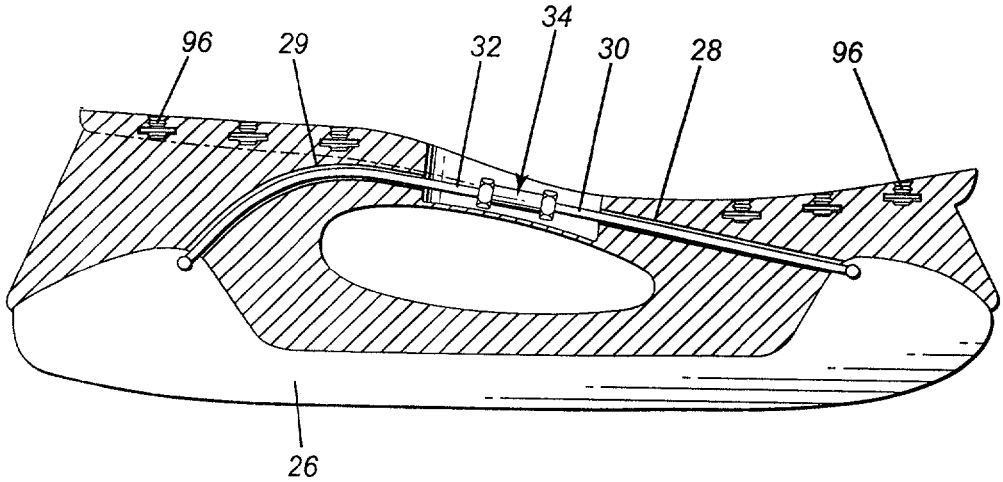
FIG. 12 is a cross sectional view taken along the line 11-11 of FIG. 10.
Figure 13:
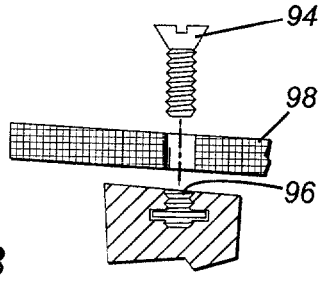
FIG. 13 is an enlarged view illustrating the attachment of a boot portion to a blade assembly.

Blade assembly 14 includes a blade support portion 24 and which has a blade 26 retained thereby. As may be best seen in FIGS. 8 and 11, blade support portion 24 has a pair of channels 28, 29 formed therein, channel 28 extending from the front of blade 26 to a central area with rear channel 29 extending from a rear portion of blade 26 to the central area. A front flexible tensioning cable 30 extends through front channel 28 and a rear flexible tensioning cable 32 extends through the rear channel 29. Tensioning cables 30 and 32 are connected together by means of a tightening assembly generally designated by reference numeral 34 and having nut portions 36 at that end thereof which are adapted to screw threadedly engage cables 30 and 32. By turning of nuts 36, the tension on tensioning cables 30 and 32 can be adjusted.

Figure 7:
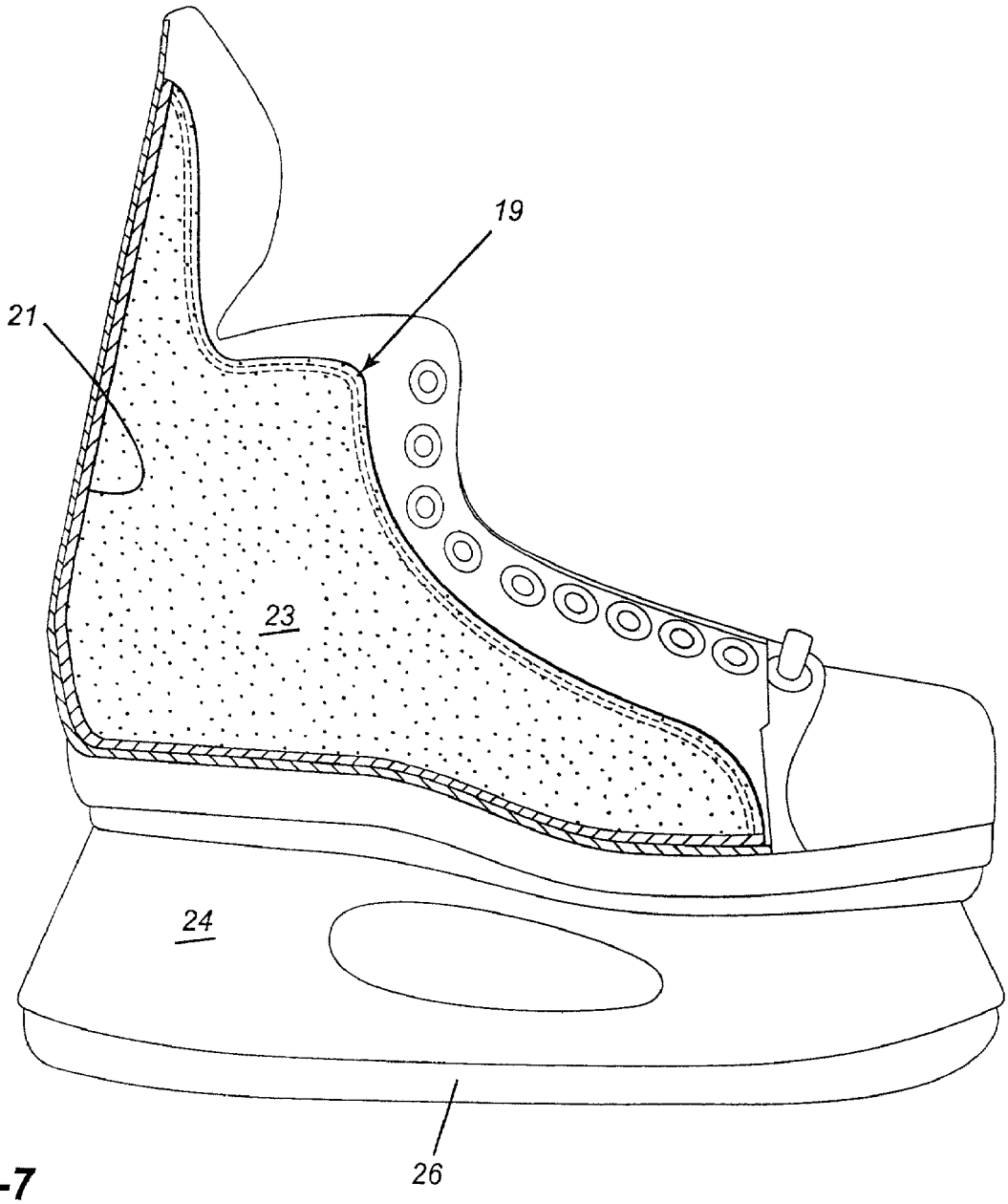
FIG. 7 is a side elevational view, partially in cut-away, showing the inner boot portion.

As may be best seen in FIG. 7, inner boot 19 comprises a pair of sides (only one side 23 being shown) and an interconnecting back portion 21. It will be noted that the sides terminate short of the toe area.

Figure 5:
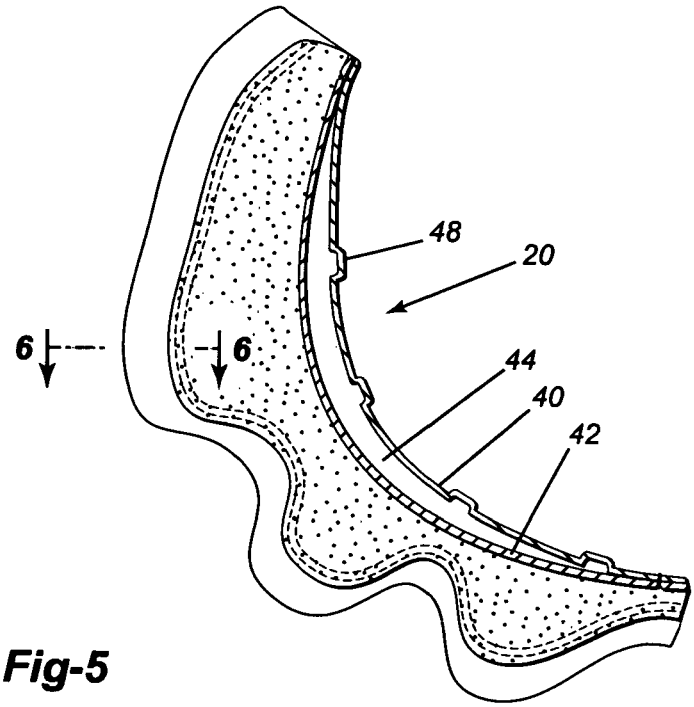
FIG. 5 is a sectional view of a tongue assembly according to the present invention.
Figure 6:
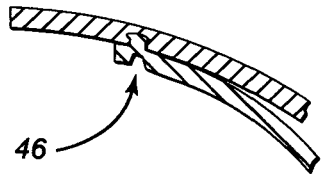
FIG. 6 is a sectional view taken along the lines 6-6 of FIG. 5.

The tongue structure of the present invention is best illustrated in FIG. 5 and reference will now be made thereto. Tongue 20 includes an upper protective layer 40 which may be made of a suitable protective material such as plastic or even a thin sheet of metal. It is preferably somewhat resilient for reasons which will become apparent hereinbelow. Secured to protective layer 40 is a lower layer 42 which is preferably of a somewhat elastic material such as rubber. In between upper protective layer 40 and lower layer 42 is an air space 44. Upper protective layer 40 and lower layer 42 are secured together by means of a locking arrangement as shown in FIG. 6. A plurality of transversely extending ribs 48 are formed in upper protective layer 40. Tongue 20 has a pair of side edges (only one edge 21 is shown) with outwardly extending scallops 23 having inwardly extending recesses 25 therebetween.

The present invention employs a plurality of cables 50 which are used to apply a tightening force on tongue 20. Each cable 50 extends through a corresponding channel 52. Each cable 50 is attached to the sides of tongue 20 and to this end, as may be seen in FIG. 2, cable 50 passes through an aperture in plate 56 and is then secured by means of screw 54. An anchor bar 58 is provided interiorly to spread the tensioning force over a wider area.

Figure 2:
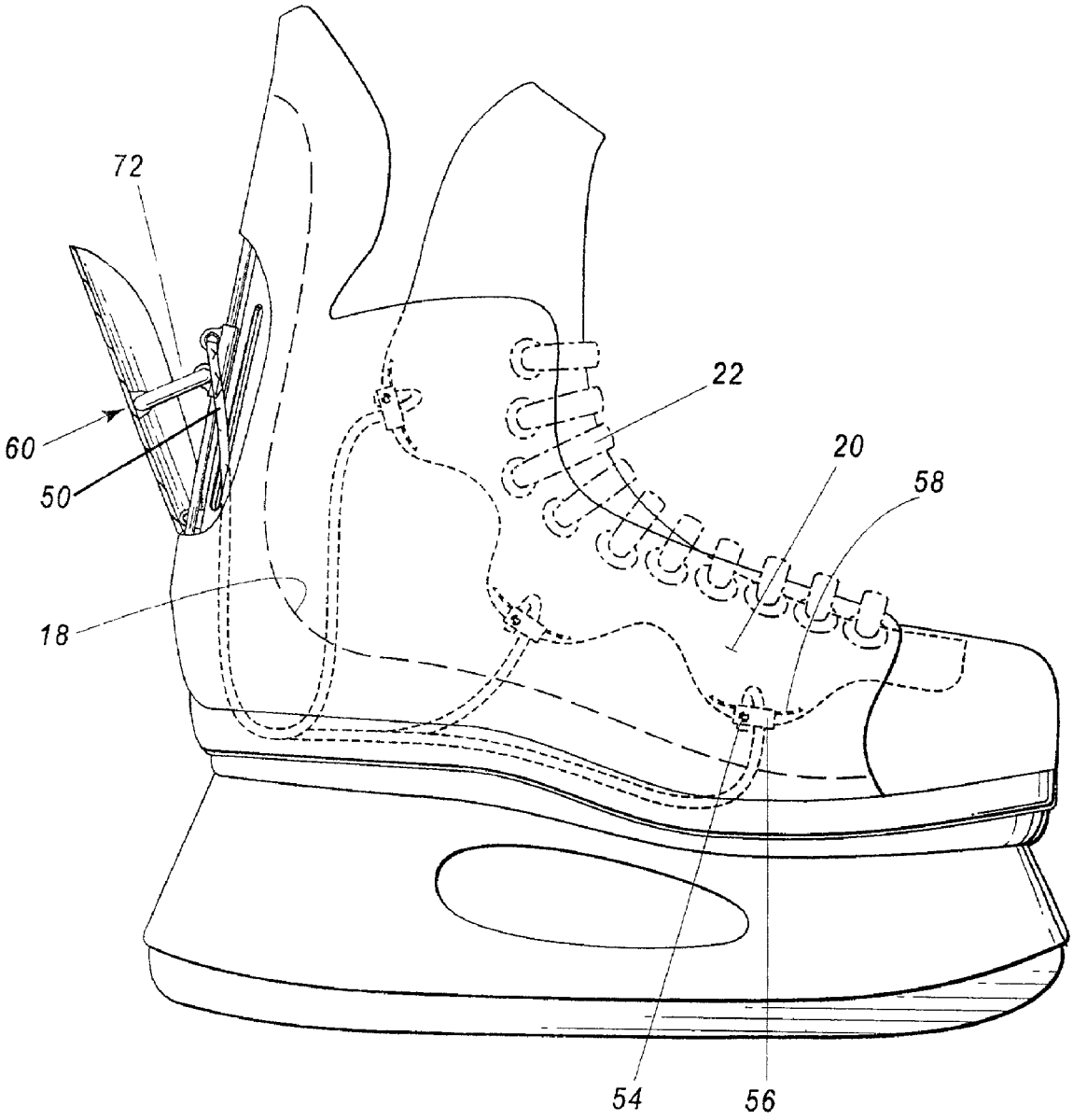
FIG. 2 is a side elevational view, with certain interior components shown in dotted lines, of the skate of FIG. 1.
Figure 3:
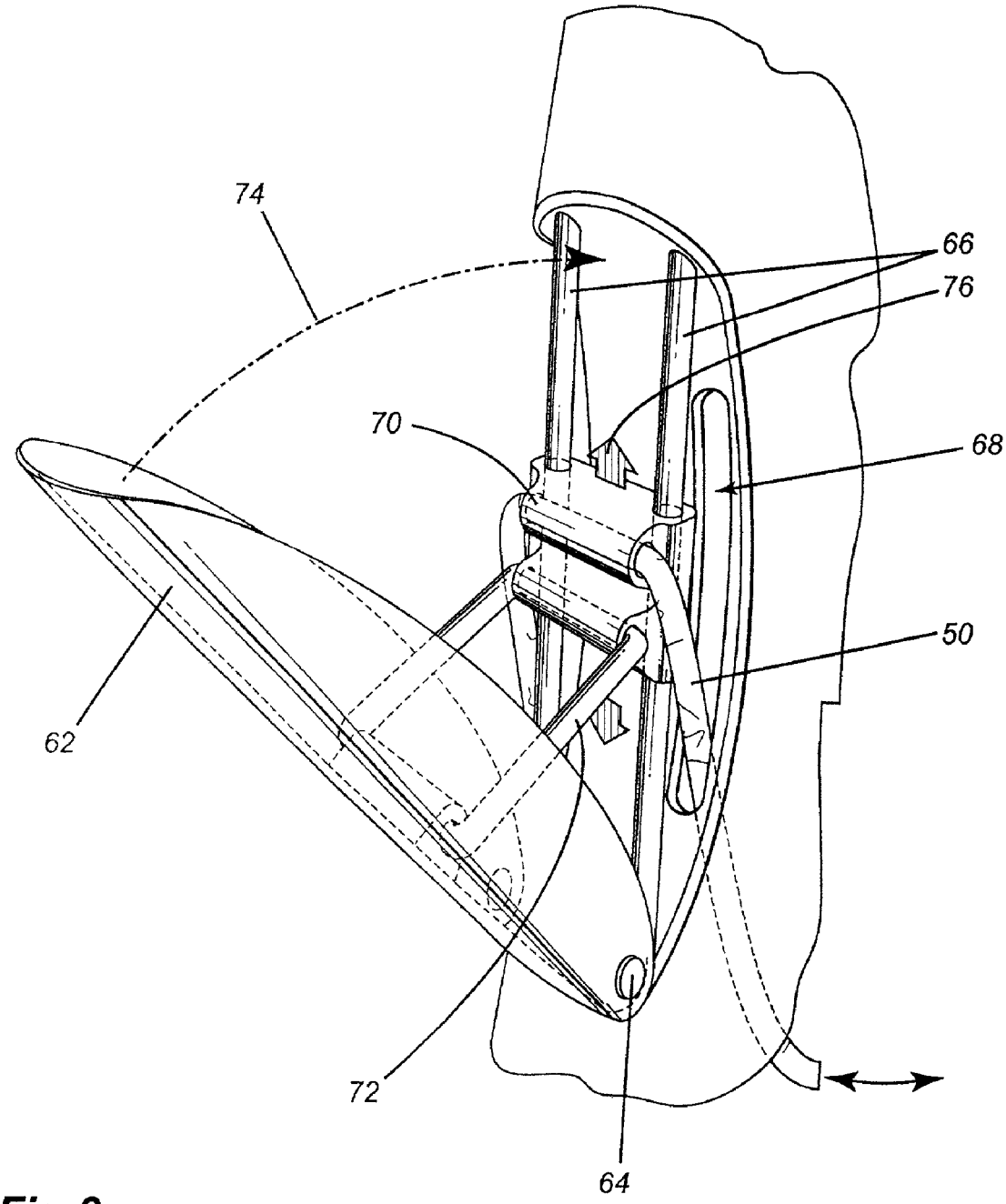
FIG. 3 is a perspective view of one embodiment of a cable adjusting mechanism according to the present invention.

At the other end, each cable 50 is secured to a cable tensioning means generally designated by reference numeral 60. One embodiment of this is illustrated in FIGS. 2 and 3 wherein there is provided a pivotable plate member 62 connected at pivot point 64 to the outer shell 16. A pair of vertical guides 66 are designed to receive a slider 68. Cables 50 are attached to slider 68 by means of a cable attachment portion 70. A push rod 72 interconnects slider 68 and pivotable plate 62 such that a closing movement as indicated by arrow 74 will cause slider 68 to move upwardly as indicated by arrow 76 and thereby apply tension to cables 50. With respect to cables 50, each preferably comprises a relatively thin wire of metallic or other suitable material and which are joined together at the ends where they are attached to the cable tensioning means. For ease of illustration, the securing together of cables 50 has not been shown.

In use, a boot may be tightened by applying tension on cables 50 by means of cable tensioning means 60. The force exerted on the sides of tongue 20 will tend to stretch lower layer 42 and also place upper protective layer 40 in a state of tension. An air space 44 is maintained between upper protective layer 40 and lower layer 42 which are separated by a distance of between 50 mm and 100 mm. In the described embodiment, laces 22 may be tightened, but are largely superfluous since the foot is retained in the boot by tongue 20. This also provides a far more comfortable arrangement as the upper portion of the foot and ankle flex against a resilient and flexible lower layer 42.

Figure 4:
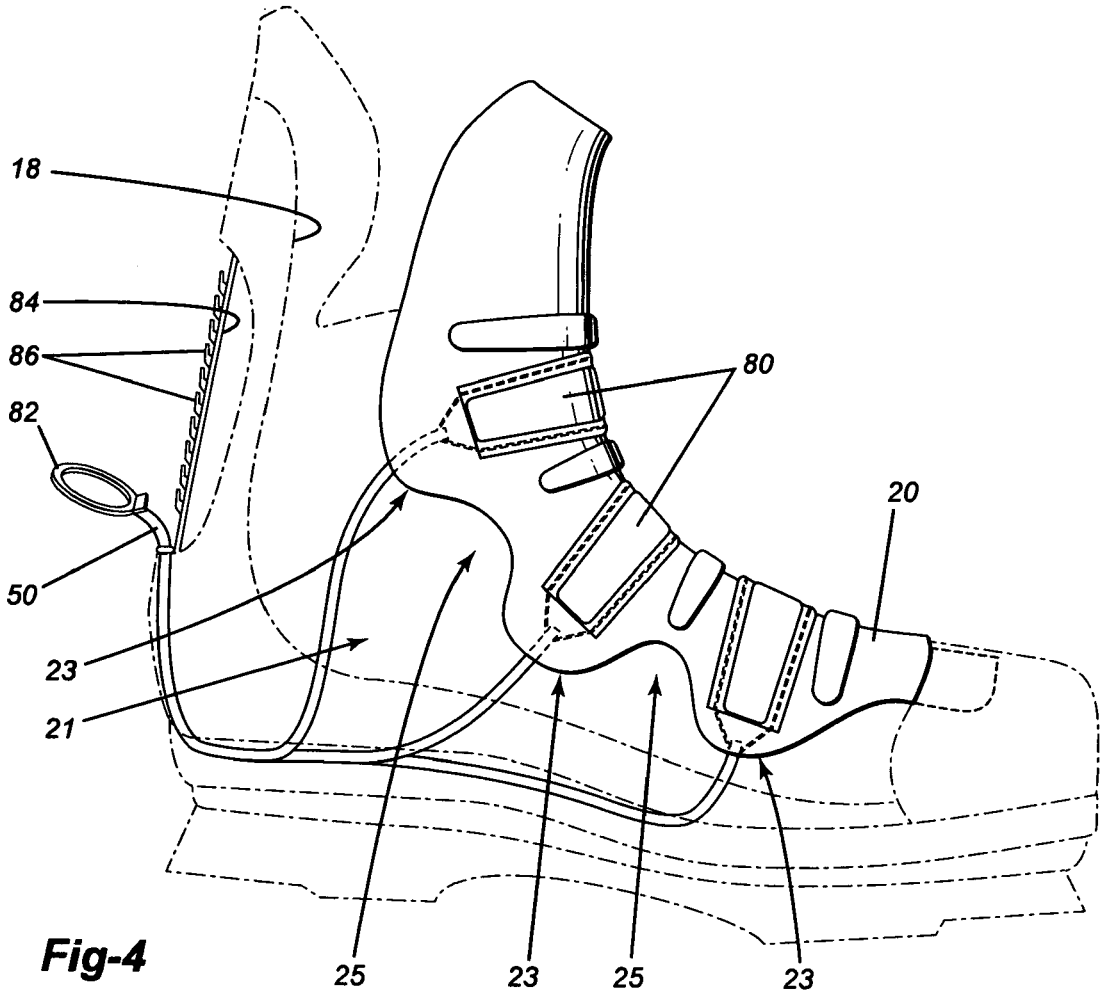
FIG. 4 is a side elevational view, with certain interior components shown in dotted lines, of a further embodiment of a boot having a cable tightening system.

An alternative arrangement is illustrated in FIG. 4 wherein the tongue 20 has a plurality of straps 80 extending thereacross. Straps 80 are interconnected to cables 50. In view of the cable tensioning means 60 previously described, cables are connected to a ring 82 which is securable to a ring retaining member 84 mounted on the heel or back of the boot and which has projections 86 extending slightly upwardly.

According to the present invention, sole 90 is provided with a plurality of apertures therein designed to receive screws 94 which extend downwardly through outer shell 16 and wherein a plurality of screws 94 are screw threadedly engaged with apertures 96 in blade support 24. A centrally located aperture 95 provides access to tightening assembly 34.

Also according to the present invention, there is provided a member 98 interposed between blade support portion 24 and sole 90. Member 98 may be used to adjust the level of either the heel or toe portion such that the skate may be given a desired height on either the toe or heel portion.

As will be seen from the above, there is provided a skate assembly which includes a number of improvements over conventional technology. It will be understood that many of these improvements can be applied to other footwear such as boots employed in other sports including roller blades, ski and snowboard boots, cross country boots, work boots and the like.

It will be understood that the above described embodiments are for purposes of illustration only and that changes or modifications may be made thereto without departing from the spirit and scope of the invention.

I claim:

1. A tongue structure for use in boot, said tongue structure comprising an upper layer formed of a rigid protective material, a lower layer formed of a resilient stretchable material, said upper layer being secured to said lower layer along marginal side edges thereof, said upper layer being spaced from said lower layer intermediate said side marginal edges to thereby provide an air space between said upper and lower layers, the arrangement being such that when said tongue is used in a boot, the foot of a user will contact said lower layer with said upper layer being spaced therefrom in a central region.

2. The tongue structure of claim 1 wherein said lower layer is formed of a rubber material.

3. The tongue structure of claim 1 wherein said upper layer is formed of a plastic material, said upper layer being resilient such that when pressure is applied to a central portion thereof, said side marginal edges will move apart.

4. The tongue structure of claim 3 wherein said upper and lower layers are spaced apart a distance of between 1 cm and 3 cm at a central portion intermediate said side marginal edges.

5. In an ice skate having a boot, a blade support portion mounted on said boot, and a blade mounted in said blade support portion, the improvement comprising a first cable member connected to an upper front portion of said blade, a second cable member being secured to an upper rear portion of said blade, said first and second cable members extending through said blade support portion and being connected to each other.

6. The improvement of claim 5 wherein said first and second cable members are adjustably connected together by tensioning means, said tensioning means being operative to adjust the tension on said cables.

7. The improvement of claim 6 wherein said boot has an aperture in a sole portion thereof, said aperture providing access to said cable tensioning means within said blade support member.

8. The improvement of claim 5 wherein, said boot has a sole portion, a plurality of screw threaded members extending through said sole portion to attach said boot and said blade support member together.

9. The improvement of claim 8 further including at least one shim member mounted between said sole and said blade support member.

10. The improvement of claim 8 wherein said blade support member has a front section secured to said boot and a rear section secured to said boot, said front and rear sections being spaced apart.

11. The improvement of claim 9 including a plurality of shim members such that either said front or rear portions may be shimmed.

* * * * *